US006332903B1

(12) United States Patent
Otani

(10) Patent No.: US 6,332,903 B1
(45) Date of Patent: Dec. 25, 2001

(54) MATERIALS PROCESSING CYLINDER CONTAINING TITANIUM CARBIDE

(76) Inventor: Tony U. Otani, 12438 Eckleson St., Cerritos, CA (US) 90703

( * ) Notice: Subject to any disclaimer, the term of this patent is extended or adjusted under 35 U.S.C. 154(b) by 0 days.

(21) Appl. No.: 09/632,069

(22) Filed: Aug. 4, 2000

(51) Int. Cl.[7] ..... C22C 29/10
(52) U.S. Cl. ..... 75/236; 75/252
(58) Field of Search ..... 75/236, 252; 428/545, 428/680, 627

(56) References Cited

U.S. PATENT DOCUMENTS

| | | | | |
|---|---|---|---|---|
| 3,836,341 | | 9/1974 | Saltzman et al. . | |
| 3,977,837 | * | 8/1976 | Mal et al. . | |
| 4,156,606 | * | 5/1979 | Frehn | 75/236 |
| 4,180,401 | * | 12/1979 | Frehn | 75/236 |
| 4,194,910 | * | 3/1980 | Mal et al. | 75/236 |
| 4,430,389 | | 2/1984 | Otani | 428/627 |
| 4,650,353 | * | 3/1987 | Rymas | 400/124 |
| 4,704,336 | * | 11/1987 | Spriggs | 428/552 |
| 4,731,115 | * | 3/1988 | Abkowitz et al. | 75/236 |
| 4,766,042 | | 8/1988 | Otani | 428/679 |
| 5,145,506 | * | 9/1992 | Goldstein et al. | 75/240 |

OTHER PUBLICATIONS

ASM Metals Handbook V. 13, p. 850, Fig. 6, Sep. 1987 Published by American Society for Metals International.

TiC–Coated Graphite Designed with Properties Tailored to Various Applications, R. Webb, *Industrial Heating*, May 2000 pp. 47 and 48.

"Bimetallic Cylinders" Brochure of Wexco Corp., Lynchburg, VA 24502. Dated : 1991.

"Bimetallic Cylinders" Brochure of Wexco Corp., Lynchburg, VA 24502. Dated : Prior to 1991.

* cited by examiner

*Primary Examiner*—Ngoclan Mai
(74) *Attorney, Agent, or Firm*—Peter D. Keefe

(57) ABSTRACT

A bimetallic materials processing cylinder formed of a titanium carbide alloy via a vacuum melt process, for example at a pressure of about $10^{-4}$ Torr, the purpose of which being to utilize titanium as a main ingredient binded by the best available wear and corrosion resistant alloy that will "wet", but not dissolve too much as a cermet, to thereby create a metallurgically bonded inside layer of a material processing bimetallic cylinder. The titanium carbide alloy is for example up to about 58 volumetric percent titanium carbide and the remaining volumetric percent is a predetermined bonding alloy. Preferred titanium carbide alloys are (by weight percent): titanium carbide at 24.80 to 53.60%, nickel at 44.30 to 29.20%, chromium at 13.50 to 6.00%, silicon at 3.60 to 1.75%, boron at 2.85 to 1.75%, molybdenum at 3.70 to 1.38%, copper at 1.50 to 0.46%, iron at a 3.00% maximum, carbon at a 0.45% maximum, and other materials at a 2.00% maximum.

5 Claims, 2 Drawing Sheets

MATERIALS PROCESSING CYLINDER CONTAINING TITANIUM CARBIDE

BACKGROUND OF THE INVENTION

1. Field of the Invention

The present invention is related to materials processing machine components, particularly cylinders used therefor. Still more particularly, the present invention relates to a materials processing cylinder containing titanium carbide.

2. Description of the Prior Art

Materials processing cylinders, such as used for injection and extrusion machines, plastics injection molding and extrusion processes, chemical processes, rubber, elastomer and magnesium processing, and food processing, are subjected to high temperatures, wear and corrosion attack from the materials being processed. Further, screws used for processing work material (as for example plastic) cause galling as the screw rotates within the cylinder. Additionally, such cylinders must also exhibit high strength, on the order of withstanding 30,000 psi at 1,000 degrees F. Still further, such cylinders must be cost effective and yet be highly resistant to failure when exposed to wear, corrosion, high pressure and high temperature.

Since there is no material known which meets all of the above requirements, the art has adopted the following manufacturing techniques.

Figure 1:
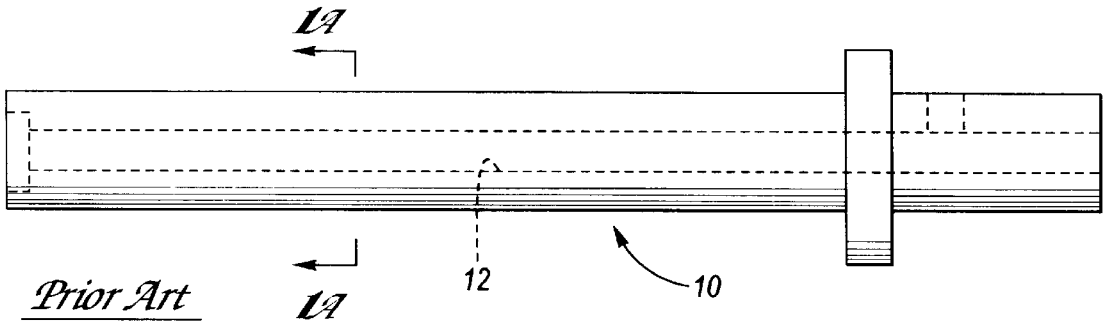
Prior Art Fig. 1
Figure 1A:
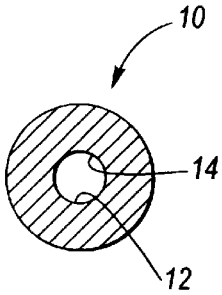
Prior Art Fig. 1A

A first technique is known as a "nitrided cylinder". As shown at FIGS. 1 and 1A, a solid, single piece cylinder 10 is provided, composed of nitrided steel. The inside surface 12 of the cylinder 10 is nitrided and then machine polished to provide a nitrided skin 14, typically about 0.010 inches thick. Problematically, the nitrided skin 14 is easily spalled off, has poor corrosion resistance, and has high manufacturing cost for larger size cylinders.

Figure 2:
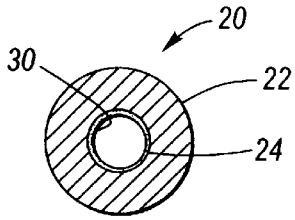
Prior Art Fig. 2

A second technique is known as a "bimetallic cylinder", and is the most popular technique. As shown at FIG. 2, a composite cylinder 20 is provided having an outside layer 22 composed of a high strength steel, and an inside layer 24 composed of an inlay alloy metallurgically bonded thereto and typically about 0.065 inches thick, and wherein the outside layer 22 serves as a backing for the inside layer 24.

Figure 3A:
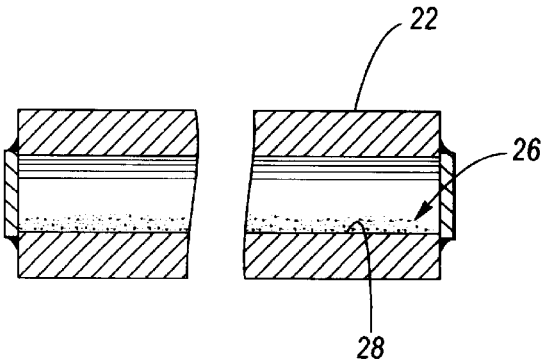
Prior Art Fig. 3A
Figure 3B:
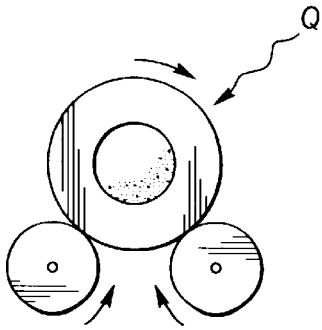
Prior Art Fig. 3B

The centrifugal casting process used for forming the inside layer 22 is shown at FIGS. 3A and 3B. An inlay alloy material in the form of shots, ingots or powder 26 is distributed along the inside surface 28 of the outside layer 22. Then, the outside layer 22 is slowly rotated and heat Q is applied to achieve a temperature above 2,200 degrees F. The outside layer 22 is then spun at room temperature to provide, for example, a centrifugal force of over 70G's. During this process, the inlay alloy melts and forms a uniform coating, which upon cooling, provides the inner layer 24. Typical inlay alloys are: Fe—Ni—B, having a hardness of Rc 60–65, and having good wear resistance, but poor corrosion resistance; Co—Ni—B, having a hardness of Rc 48–55, and having good corrosion resistance, but poor resistance to abrasion; and, carbides, mostly with tungsten carbide powder bound by a Ni—Cr—B matrix alloy with a lower melting point, which inlay alloy is superior to the first two inlay alloys, as described in U.S. Pat. No. 3,836,341 and 4,430,389 which are hereby herein incorporated by reference.

Due to an increase in the use of technical plastics containing abrasive and corrosive additives, such as high glass fiber fillings, pigments, UV stabilizers, and flame retardants, the inside surface of processing cylinders are subjected to severe wear and corrosion conditions. The bimetallic cylinders discussed in U.S. Pat. Nos. 3,836,341 and 4,430,389 utilize tungsten carbide to provide corrosion and wear resistance, but nevertheless suffer from the following disadvantages.

1. The centrifugal force of the bimetallic cylinder casting process tends to spin high density tungsten carbide to the outer wall of the inner cylinder. Consequently, there are fewer tungsten carbide particles at the machine finished inside surface of the inner cylinder.

2. Tungsten carbide has a relatively high coefficient of friction. Therefore, frictional wear of the processing screw flight surface occurs where contact is made with the inner surface.

3. Tungsten carbide has a relatively high density and high cost per pound weight.

4. Tungsten carbide does not exhibit good corrosion resistance to hydrochloric and hydrofluoric acid atmosphere attacks, a condition that is presented by most resins.

Accordingly, what is needed is a material for a materials processing cylinder composed of a material which is not subject to the above recounted disadvantages.

SUMMARY OF THE INVENTION

The present invention is a materials processing cylinder having an internal lining composed of a titanium carbide alloy suitable for high pressure (as for example around 30,000 psi (207 MPa)), high temperatures (as for example around 500 to 1,200 degrees F. (260 to 649 degrees C.), extreme wear (as for example from glass fiber fillers and abrasive additives), corrosive atmospheres (as for example hydrochloride and hydrofluoride), and magnesium injection and casting processes.

Titanium carbide has a micro hardness of HV(50 kg) 3,000 as compared to HV(50 kg) 2,200 for tungsten carbide, giving titanium carbide a superior level of wear resistance. The frictional coefficient of titanium carbide is about 35 percent to about 40 percent lower than the coefficient of friction of tungsten carbide, resulting in titanium carbide providing less galling wear against the contacting screw surfaces as compared with tungsten carbide. Titanium carbide is further corrosion resistant in low pH environments, as for example occurring in hydrochloric acid and hydrofluoric acid environments. Still further, titanium carbide is known not to alloy with magnesium, therefore rendering titanium carbide an ideal composition for materials processing cylinders utilized in magnesium injection molding and die casting operations. Lastly, titanium carbide has a lower density (4.91 gm/cm$^3$) than the density (15.67 gm/cm$^3$) of tungsten carbide. As a result, there is less gravitational segregation at the surface It is known that titanium carbide is a refractory metal that is very difficult to fuse and melt in an air atmosphere. Accordingly, titanium carbide cannot be processed to form a bimetallic materials processing cylinder using a conventional air melt centrifugal cast bimetallic fabrication process. Therefore, the present invention provides a bimetallic materials processing cylinder formed of a titanium carbide alloy via a vacuum melt process, for example at a pressure of about $10^{-4}$ Torr. The titanium carbide alloy is for example up to about 58 volumetric percent titanium carbide and the remaining volumetric percent is a predetermined bonding alloy.

An example of preferred titanium carbide alloys are given in Table 1.

TABLE 1

| Component | Percent Weight |
|---|---|
| Titanium Carbide | 24.80 to 53.60 |
| Nickel | 44.30 to 29.20 |
| Chromium | 13.50 to 6.00 |
| Silicon | 3.60 to 1.75 |
| Boron | 2.85 to 1.75 |
| Molybdenum | 3.70 to 1.38 |
| Copper | 1.50 to 0.46 |
| Iron | 3.00 maximum |
| Carbon | 0.45 maximum |
| Other | 2.00 maximum |

A hardness test was performed on the titanium carbide alloys of Table 1, indicating a Rockwell C scale of between 62 and 66, which is acceptable for severe wear service. Further, a wear test was performed on the titanium alloys of Table 1 using the ASTM G77 block-on-ring method, modified to a load of 300 pounds and 20,000 cycles duration, which test was similar to tests of two tungsten carbide alloys, as indicated in Table 2.

TABLE 2

| Alloy | Wear Scar Width (mm) | Equiv. Volumetric Loss ($mm^3$) | Friction Coefficient |
|---|---|---|---|
| Alloys of Table 1 | 0.631 | 0.0076 | 0.093 |
| Alloy of Patent 4,430,389 (46–57 wt % WC Grade) | 0.669 to 0.687 | 0.0091 to 0.0098 | 0.143 to .145 |
| Alloy of Patent 3,836,341 (30–45 wt % WC Grade) | 0.698 to 0.992 | 0.010 to 0.029 | over 0.13 |

For purposes of evaluation, less scar width and less volumetric loss translates into less wear loss; and lower frictional coefficient translates into less tendency towards galling wear at contacting screw surfaces. The test results indicate that the titanium carbide alloys of the present invention will perform better than tungsten carbide alloys.

Accordingly, it is an object of the present invention to provide a materials processing cylinder having an inner lining composed of a titanium carbide alloy.

It is an additional object of the present invention to provide a materials processing cylinder having an internal lining composed of a titanium carbide alloy suitable for high pressure (as for example around 30,000 psi (207 MPa)), high temperatures (as for example around 500 to 1,200 degrees F. (260 to 649 degrees C.), extreme wear (as for example from glass fiber fillers and abrasive additives), corrosive atmospheres (as for example hydrochloride and hydrofluorides), and magnesium injection and casting processes.

These, and additional objects, advantages, features and benefits of the present invention will become apparent from the following specification.

DETAILED DESCRIPTION OF THE PREFERRED EMBODIMENT

The purpose of the present invention is to utilize titanium as a main ingredient binded by the best available wear and corrosion resistant alloy that will "wet", but not dissolve too much as a cermet, to create a metallurgically bonded inside layer of a material processing bimetallic cylinder. A "cermet" is an acronym designating a heterogeneous combination of metal or alloys with one or more ceramic phase, such as metallic carbides, including titanium carbide, in which there is relatively little solubility between metallic and ceramic phase at the preparation temperature.

Titanium carbide has been known for its high hardness (HV (50 kg) 3,000 and high acid corrosion resistance as compared with tungsten carbide. Its lower coefficient of friction as compared with tungsten carbide translates into reduced wear due to galling against screw materials. Further, the low density of titanium carbide translates into reduced manufacturing costs as compared with tungsten carbide.

Most bimetallic cylinders are formed by an air melt heating process followed by a centrifugal spinning process during solidification. However, it is impossible to fuse titanium carbide to successfully form a cermet because the "wetability" of titanium carbide is greatly retarded by the presence of oxygen.

The present invention solves this problem by studying the best composition and processes that will provide a sound titanium carbide cermet for the lining material of the inside surface of a bimetallic materials processing cylinder.

Titanium carbide has a much poorer "wetability" with most nickel based high hardness binding alloys, as compared with tungsten carbide. For the melt study according to the present invention, titanium carbide of approximately 150 mesh particles are blended with approximately same size binding alloy particles, and then loaded into molds composed of graphite and low carbon steel having a size one-quarter inch by five inches by six inches, and finally heating to 2,015 degrees F. in a vacuum of $10^{-5}$ Torr for twenty minutes. After cooling, the molds were disassembled for evaluation of soundness of solidification. Results of the melt test are given in Table 3.

TABLE 3

| Test No. | TiC Volume % (Apparent Vol.) | TiC Weight % | Ingot Appearance | Hardness Rc |
|---|---|---|---|---|
| 1 | 95 | 90.4 | Poor Fusion | Not available |
| 2 | 90 | 81.8 | Poor Fusion | Not available |
| 3 | 80 | 66.6 | Poor Fusion | Not available |
| 4 | 70 | 53.6 | Slightly Fused | Not available |
| 5 | 60 | 42.6 | Better Fused | Not available |
| 6 | 50 | 33.1 | Good Fusion, Brittle | Not available |
| 7 | 40 | 24.8 | Good Fusion, Solid | 62.2 to 66.1 |

The titanium carbide alloy of test number 7 of Table 3 exhibited a soundly solidified structure and had a measured high hardness of between Rc 62.2 to 66.1. The titanium carbide alloy of test number 7 was further tested for wear. The wear test was conducted per the ASTM G-77 block-on-ring method, modified to a load of 300 pounds, and a total cycle of 20,000, as this method is believed to be the best currently recognized testing method for simulation of a materials processing cylinder and rotative screw therein, wherein the ring represents the screw flights and the block represents the inside surface of the materials processing cylinder. Test results were evaluated by the wear scar width located at the center of the test block and the volume corresponding to the arc area of the scar width. Test results were compared with two tungsten carbide grades which were tested previously under the same conditions, and are given in Table 2.

The result of this test, shown at Table 2, indicates that the titanium carbide alloy of the present invention having 40 volumetric percent titanium carbide or 24.2 weight percent titanium carbide, has equal or better wear resistance than other tungsten carbide grades. Further, the lower frictional coefficient of 0.093, which is more than 35% lower than that of the other tungsten carbide grades, means much less wear of metal to metal contact, ie., at the inside surface of a materials processing cylinder as the screw rotates therein. Increased fusion temperature and time should improve "wetability" for alloys with higher titanium carbide content.

Figure 5:
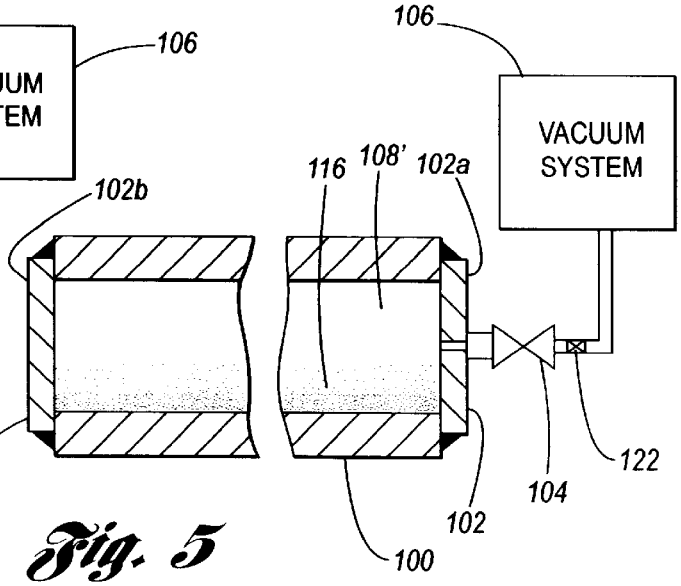

Titanium carbide with a nickel based alloy as a binder, has been known to be excellent for lower pH, strong acid environments as compared with tungsten carbide grades (see for example "ASM Metal Handbook", Vol. 13, page 850 or "Industrial Heating", April, 2000, page 48, FIG. 5).

Titanium carbide is a refractory metallic compound that cannot be successfully "wet" by its binding alloys, such as nickel based chromium, molybdenum, silicon, and boron containing alloys, and therefore cannot be centrifugally cast for a bimetallic materials processing cylinder under an air melt atmosphere.

Figure 4:
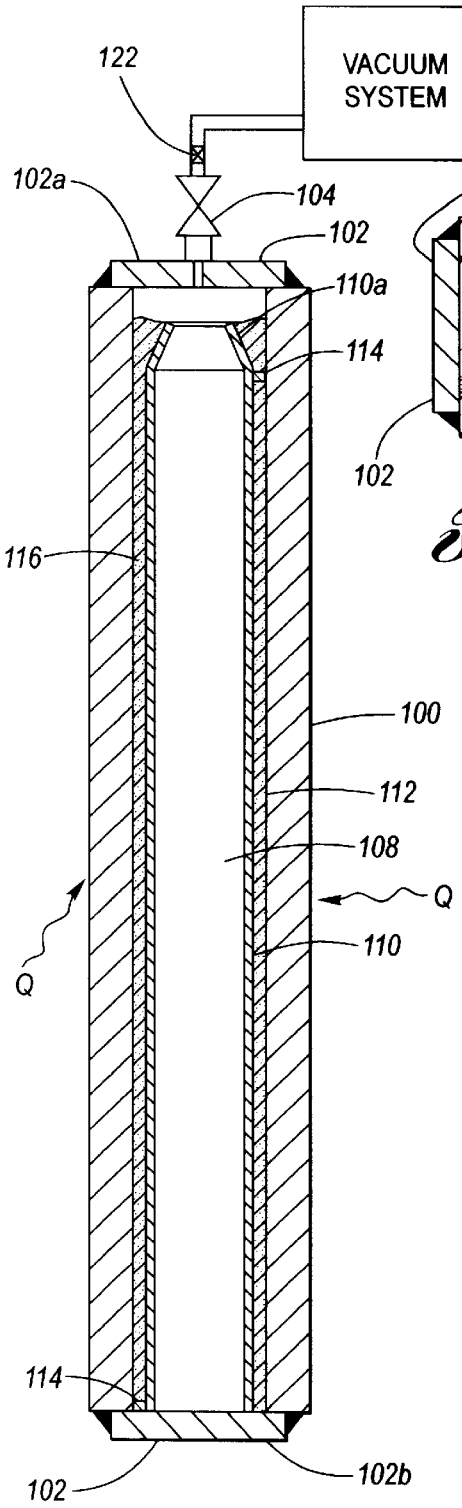
Figure 6:
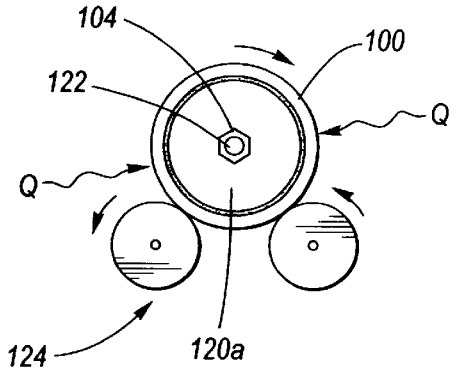

Referring now to FIGS. 4 through 7, the manufacture of a materials processing bimetallic cylinder will be detailed in accordance with the present invention, wherein a static casting method is shown at FIG. 4 and a centrifugal casting method is shown at FIGS. 5 and 6.

An outer backing cylinder 100 has both ends thereof sealed by end caps 102 via a welding attachment. The outer backing cylinder 100 and first and second end caps 102*a*, 102*b* are, for example, a low alloy, high strength steel. The first end cap 102*a* is provided with a shut-off valve 104 suitable for high temperatures. The shut-off valve 104 is connected with a conventional vacuum system 106. The vacuum system 106 provides a vacuum (or reduced gas pressure atmosphere) at an inner space 108, 108' within the outer backing cylinder, for example on the order of $10^{-4}$ Torr.

Figure 7:
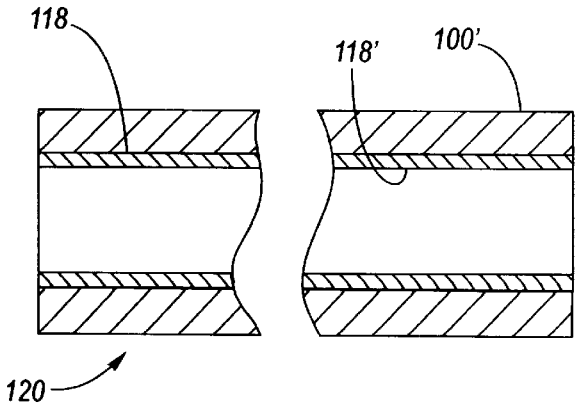

In the case of the static casting method of FIG. 4, the outer backing cylinder 100 is oriented vertically and a core tube 110 is inserted concentrically thereinto, wherein the outside diameter of the core tube is less than the inside diameter of the outer backing cylinder, creating a fill space 112, typically from about 0.065 of an inch to about 0.100 of an inch in circumferential thickness. The location of the core tube 110 is concentric relative to the outer backing cylinder 100 assured by circumferentially spaced apart spacers 114 at either end. The second end cap 102*b* is already welded to the outer backing cylinder. Powder mixes 116 of titanium carbide alloy according to the present invention is/are loaded into the fill space 112, aided by a narrowed neck 110*a* of the core tube 110, and assisted by vibration when required. The first end cap 102*a* is welded to the outer backing cylinder, sealing the inner space 108. The vacuum system 106 then evacuates the inner space 108, and the shut-off valve 104 is closed and detached from the vacuum system via a disconnect 122. Heat Q is uniformly applied to the outer surface of the outer backing cylinder 100. The powder mix 116 melts and is then allowed to solidify into a titanium carbide alloy layer (118 shown in machined and polished in FIG. 7). Subsequently, as shown at FIG. 7, the outer backing cylinder 100' is cut to remove the end caps and a machining process (known in the art) is used to remove the core tube and a small portion of the titanium carbide alloy layer. A honing or grinding step (known in the art) is then used to provide a smooth finish to the inner surface 118' of the titanium carbide alloy layer 118 to thereby provide a materials processing bimetallic cylinder 120 according to the present invention.

In the case of the centrifugal casting method of FIGS. 5 and 6, the outer backing cylinder 100 is oriented horizontally. Powder mixes 116 of titanium carbide alloy according to the present invention is/are placed into the outer backing cylinder and distributed along its length. The first and second end caps 102*a*, 102*b* are welded to the outer backing cylinder, sealing the inner space 108'. The vacuum system 106 then evacuates the inner space 108'. The shut-off valve 104 is closed and then detached from the vacuum system 106 via a disconnect 122. The outer cylinder 100 is then placed upon a conventional spin system 124 and rotated slowly while Heat Q is uniformly applied to the outer surface of the outer backing cylinder, causing the powder mix 116 to melt. The outer cylinder is then quickly spun via the spin system 124 to achieve a centrifugal force on the order of over about 70 G's so as to uniformly distribute the melt of titanium carbide alloy. The melt is allowed to solidify into a titanium carbide layer (118 shown in machined and polished in FIG. 7). Subsequently, as shown at FIG. 7, the outer backing cylinder 100' is cut to remove the end caps and a machining process (known in the art), if necessary, may be used to remove a small portion of the titanium carbide ally layer. A honing or grinding step (known in the art) is then used to provide a smooth finish to the inner surface 118' of the titanium carbide alloy layer 118 to thereby provide a materials processing bimetallic cylinder 120 according to the present invention.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A materials processing cylinder having an inner layer comprising an alloy of titanium carbide composition, said alloy comprising titanium carbide up to 58 volumetric percent of said composition.

2. The cylinder of claim 1 wherein titanium carbide comprises titanium carbide between about 24.8 and about 53.6 weight percent of said composition; and a remaining weight percent of said composition comprising a bonding alloy.

3. The cylinder of claim 2, wherein said bonding alloy is nickel based.

4. The cylinder of claim 3, wherein said bonding alloy comprises:

nickel between about 44.30 and about 29.20 weight percent of said composition;

chromium between about 13.50 and about 6.00 weight percent of said composition;

silicon between about 3.60 and about 1.75 weight percent of said composition;

boron between about 2.85 and about 1.75 weight percent of said composition;

molybdenum between about 3.70 and about 1.38 weight percent of said composition;

copper between about 1.50 and about 0.46 weight percent of said composition;

iron between about zero and about 3.00 weight percent of said composition;

carbon between about zero and about 0.45 weight percent of said composition; and other materials between about zero and about 2.00 weight percent of said composition.

5. A composition for a materials processing cylinder comprising an alloy of titanium carbide, said alloy comprising titanium carbide up to 58 volumetric percent of said composition;

wherein titanium carbide comprises between about 24.8 and about 53.6 weight percent of said composition; and a remaining weight percent of said composition comprises a bonding alloy;

wherein said bonding alloy is nickel based; and wherein said bonding alloy comprises:

nickel between about 44.30 and about 29.20 weight percent of said composition;

chromium between about 13.50 and about 6.00 weight percent of said composition;

silicon between about 3.60 and about 1.75 weight percent of said composition;

boron between about 2.85 and about 1.75 weight percent of said composition;

molybdenum between about 3.70 and about 1.38 weight percent of said composition;

copper between about 1.50 and about 0.46 weight percent of said composition;

iron between about zero and about 3.00 weight percent of said composition;

carbon between about zero and about 0.45 weight percent of said composition; and other materials between about zero and about 2.00 weight percent of said composition.

* * * * *